US008499590B2

(12) United States Patent
Yoo et al.

(10) Patent No.: US 8,499,590 B2
(45) Date of Patent: Aug. 6, 2013

(54) FILTER ASSEMBLY OF WASHER

(75) Inventors: Sang Hee Yoo, Gyeongsangnam-do (KR); Jong Deuk Bae, Gyeongsangnam-do (KR); Kil Su Kim, Gyeongsangnam-do (KR); Ji Maeng Kim, Gyeongsangnam-do (KR); Young Bae Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 548 days.

(21) Appl. No.: 12/402,126

(22) Filed: Mar. 11, 2009

(65) Prior Publication Data

US 2009/0229318 A1 Sep. 17, 2009

(30) Foreign Application Priority Data

Mar. 12, 2008 (KR) ..... 10-2008-0022974

(51) Int. Cl.
*D06F 39/10* (2006.01)

(52) U.S. Cl.
USPC ..... 68/12.13; 68/3 R; 68/235 R

(58) Field of Classification Search
USPC . 68/3 R, 12.13, 18 F, 18 FA, 235 R; 210/108, 210/167.01
See application file for complete search history.

(56) References Cited

U.S. PATENT DOCUMENTS 2,936,604 A * 5/1960 Glendening ..... 68/18 F
3,058,328 A * 10/1962 Anderson ..... 68/18 F
3,305,093 A * 2/1967 Brubaker et al. ..... 210/108
3,847,812 A * 11/1974 Ohmann ..... 210/108
3,910,076 A * 10/1975 Ruble ..... 68/18 F
4,081,975 A * 4/1978 Wortham et al. ..... 68/18 FA
5,849,182 A * 12/1998 Shin ..... 210/167.01
5,858,220 A * 1/1999 Shin ..... 210/167.01
5,863,423 A * 1/1999 Shin et al. ..... 210/167.01
5,931,027 A * 8/1999 Shin ..... 68/18 F
5,931,028 A * 8/1999 Shin et al. ..... 68/18 F
5,989,418 A * 11/1999 Shin ..... 210/167.01
6,076,378 A * 6/2000 Shin ..... 68/18 F
2004/0148974 A1 * 8/2004 No et al. ..... 68/12.13

FOREIGN PATENT DOCUMENTS

JP 59-077893 A 5/1984
JP 1-230394 A 9/1989

* cited by examiner

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

A filter assembly of a washer is disclosed, by which particles contained in water can be efficiently filtered off in the course of washing the laundry and by which the filtered-off particles are prevented from being discharged from the filter assembly. In a washer including an inner wall having an outlet and a circulation passage provided between the inner wall and a wash tub to enable water to circulate to the outlet from a bottom of the wash tub, the present invention includes a closed-type filter unit configured to filter off particles from the water discharged from the outlet and to prevent the filtered-off particles from being externally discharged.

5 Claims, 5 Drawing Sheets

FILTER ASSEMBLY OF WASHER

This application claims the benefit of the Korean Patent Application No. 10-2008-0022974, filed on Mar. 12, 2008, which is hereby incorporated by reference as if fully set forth herein.

BACKGROUND OF THE INVENTION

1. Field of the Invention

The present invention relates to a filter, and more particularly, to a filter assembly of a washer. Although the present invention is suitable for a wide scope of applications, it is particularly suitable for filtering water in a washer that filters and circulates water within a wash tub.

2. Discussion of the Related Art

FIG. 1 is a cross-sectional diagram of a washer according to a related art. In the following description, a related art washer is explained with reference to FIG. 1.

Referring to FIG. 1, a washer according to a related art consists of a main body 5 of the washer, a water storing tub 70 provided within the main body 5 to accommodate water therein, a dewatering tub 80 provided inside the water string tub 70 to perform washing and dewatering on laundry, a pulsator provided under the dewatering tub 80 to wash to laundry by rotating to generate water current, and a drive assembly 50 for rotating the pulsator 20.

And, a water supply assembly is installed over the water storing tub 70. Water supplied from the water supply assembly 10 is supplied to the water storing tub 70 and is then stored therein.

A drain assembly 10 is installed under the water storing tub 70 to discharge the water from the water storing tub 70 after completion of washing.

A passage 80*a* is provided inside the dewatering tub 80 to enable the water stored in the dewatering tub 80 to ascend over the dewatering tub 80 according to the rotation of the pulsator 20.

An injection hole 80*b* is provided to an upper part of the passage 80 to introduce the water having ascended along the passage 80*a* into the dewatering tub 80 again.

A mesh net 40 is further provided to the injection hole 80*b* to filter off particles contained in the water.

In the above-configured washer of the related art, if the pulsator 20 rotates, the water stored within the wash tub ascends along the passage 80*a*, passes through the injection hole 80*b* and the mesh net 40 to filter of particles, and is then supplied within the dewatering tub 80.

However, in the related art washer, the mesh net 40 is projected from an inner wall of the washer in part. Therefore, while laundry is washed, the laundry and the mesh net 40 collide with each other to abrade or tear the mesh net 50. If the mesh net 40 is torn, particles filtered off by the mesh net 40 may be re-introduced into the dewatering tub 80. And, the laundry is caught on the mesh net 40 to be damaged.

Moreover, the mesh net 40 is capable of filter off particles contained in the water only but is unable to inject water on laundry. Therefore, the mesh net 40 has the configuration failing to implement a function of raising wash efficiency.

SUMMARY OF THE INVENTION

Accordingly, the present invention is directed to a filter assembly of a washer that substantially obviates one or more problems due to limitations and disadvantages of the related art.

An object of the present invention is to provide a filter assembly, by which the filter assembly for filtering water is not projected from a wash tub.

Another object of the present invention is to provide a filter assembly, by which wash performance can be enhanced in a manner of filtering water and injecting the filtered water on laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a filter assembly of a washer, which includes an inner wall having an outlet and a circulation passage to enable water to circulate to the outlet from a wash tub, according to the present invention includes a closed-type filter unit configured to filter off particles from the water discharged from the outlet and to prevent the filtered-off particles from being externally discharged.

Preferably, the closed-type filter unit includes a front cover having a mesh for filtering off the particles and a rear cover assembled with the front cover to provide a sealed space.

More preferably, the rear cover includes a plurality of projections configured in a direction of the front cover.

In this case, the rear cover further includes an inlet enabling the water introduced into the outlet to be introduced into the closed-type filter unit.

And, a multitude of the projections are provided around the inlet.

More preferably, the closed-type filter unit further includes a multitude of ventilation holes configured to perforate the rear cover.

Besides, the filter assembly of the washer further includes a passage rib configured to guide an introduction of the water along a circumference of the inlet. And, a multitude of the projections are provided around the passage rib.

In this case, the passage rib is configured to incline to prevent a backward flow of the water.

Meanwhile, the filter assembly of the washer further includes a cap having an injection hole for enabling the water through the closed-type filter unit to be injected into the wash tub.

In this case, the cap is detachably attached to an upper part of the front cover.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The present invention is applicable to a washer. In this case, the washer can have one of various types including a vertical shaft type for rotating a pulsator or a wash tub and the like. In this disclosure, a vertical-shaft type washer having a rotated pulsator is taken as an example for the description of the present invention.

Figure 1:
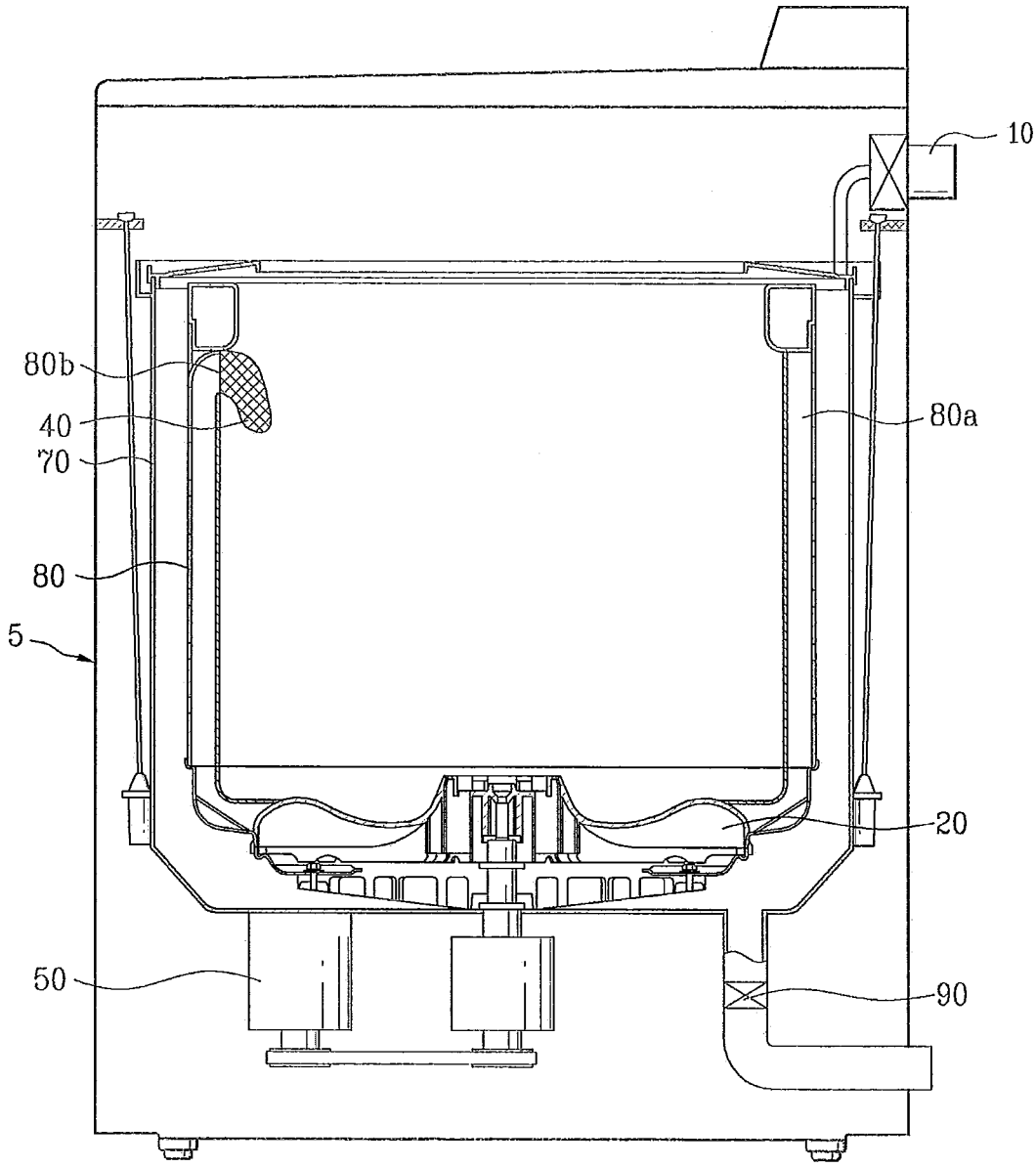
FIG. 1 is a cross-sectional diagram of a washer having a mesh net according to a related art.
Figure 2:
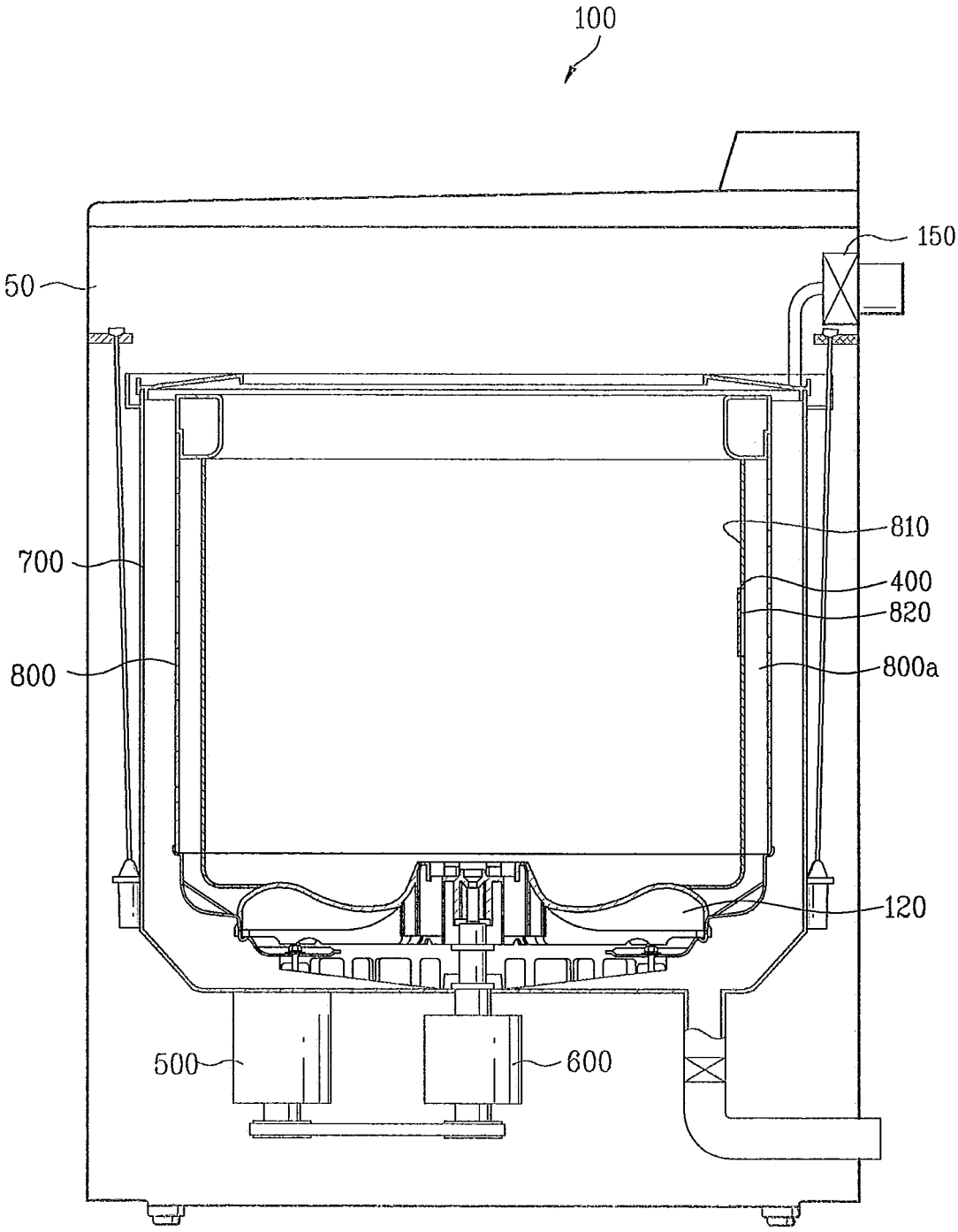
FIG. 2 is a cross-sectional diagram of a washer having a washer filter assembly according to the present invention.

FIG. 2 is a cross-sectional diagram of a washer having a washer filter assembly according to the present invention.

Referring to FIG. 2, a configuration of a washer 100 according to the present invention is explained as follows.

First of all, a washer of the present invention includes a main body 50 configuring an exterior, a wash tub 800 provided within the main body 50 to wash laundry by rotating centering on a vertical axis, and a water storing tub 700 provided outside the wash tub 800 to accommodate water therein.

A pulsator 120 is provided to an inner bottom of the wash tub 800. And, the wash tub 800 and the pulsator 120 are rotated by drive and shaft assemblies 500 and 600 provided under the water storing tub 700.

If the wash tub 800 is rotated by the drive and shaft assemblies 500 and 600, the water stored on the bottom of the wash tub 800 is able to move to an upper part of the wash tub by the corresponding rotational force via a circulation passage 800*a*.

In this case, the circulation passage 800*a* can include a space constructed with an inner wall configured to extend from the pulsator 120 and the wash tub 800.

And, an outlet 820 is provided to the inner wall 810 to enable the water having ascended via the circulation passage 800*a* to be introduced into the wash tub 800.

Meanwhile, a water supply assembly (150) for supplying water to the water storing tub 700 can be provided over the water storing tub 700 by being connected to an external water supply source of the washer.

In the following description, a filter assembly 400 provided to the above-configured washer of the present invention is explained.

Figure 3:
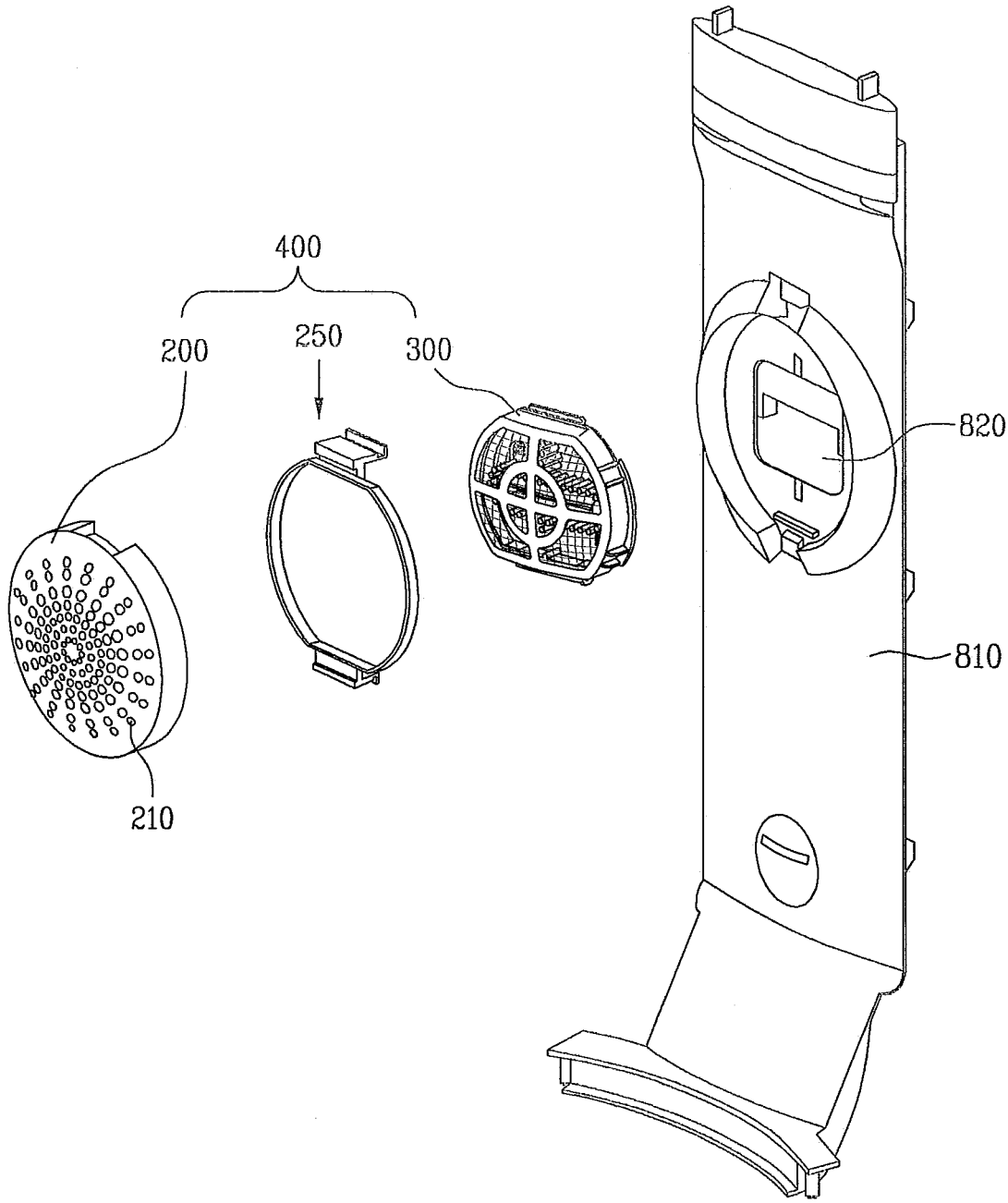
FIG. 3 is an exploded perspective diagram of a washer filter assembly according to the present invention, in which a separated configuration of the washer filter assembly prior to being assembled to a washer is shown.

FIG. 3 is an exploded perspective diagram of a washer filter assembly according to the present invention, in which a separated configuration of the washer filter assembly prior to being assembled to a washer is shown.

Referring to FIG. 3, a washer 100 of the present invention includes a filter assembly 400 enabling water, which ascends the circulation passage 800*a* and introduced into the outlet 820, to be filtered and injected.

The filter assembly 400 can be detachably provided to the outlet 820 provided to the inner wall 810. Preferably, the filter assembly 400 is inserted in the inner wall 810 to configure the same plane of a plane configured by the inner wall 810.

This is to prevent laundry from being damaged by friction generated between the laundry and the filter assembly 400 when the laundry is washed through the rotation of the wash tub.

For this, the inner wall 810 is preferably configured to have a recess for enabling the filter assembly 400 to be accommodated therein. And, the filter assembly 400 is preferably assembled to the bent inner wall 810.

The filter assembly 400 includes a cap 200 for injecting water into the wash tub 800 and a closed-type filter unit 300 detachably assembled with the cap 200 to filter the water introduced from the outlet 820.

And, the filter assembly 400 according to the present invention can further include a detaching device 250 enabling the cap 200 and the closed type filter unit 300 to be assembled to the outlet 820 provided to the inner wall 810 of the washer.

The detaching device 250 can be built in one body of the cap 200. Alternatively, the detaching device 250 can be provided separate from the cap 200 to enable both of the cap 200 and the closed-type filter unit 300 to be detachably assembled to the inner wall 810.

The cap can be configured in a circular shape to enable the closed-type filter unit 300 to be detachably inserted therein. Alternatively, a multitude of injection holes 210 can be radially provided to a front side of the cap 200 to enable the water having passed through the closed-type filter unit 330 to be evenly injected into the wash tub.

A multitude of the injection holes 210 are configured to inject the water, which was filtered by the closed-type filter unit 300, into the wash tub 800.

In particular, the water, which is filtered by the closed-type filter unit 300 and then circulates into the wash tub 800, is made to pass through a narrow passage so as to be injected over the laundry within the wash tub 800.

Therefore, according to the filer unit of the washer of the present invention, since the water circulating into the wash tub 800 is injected on the laundry, the effect of beating and washing the laundry can be caused to enhance wash performance.

Figure 4A:
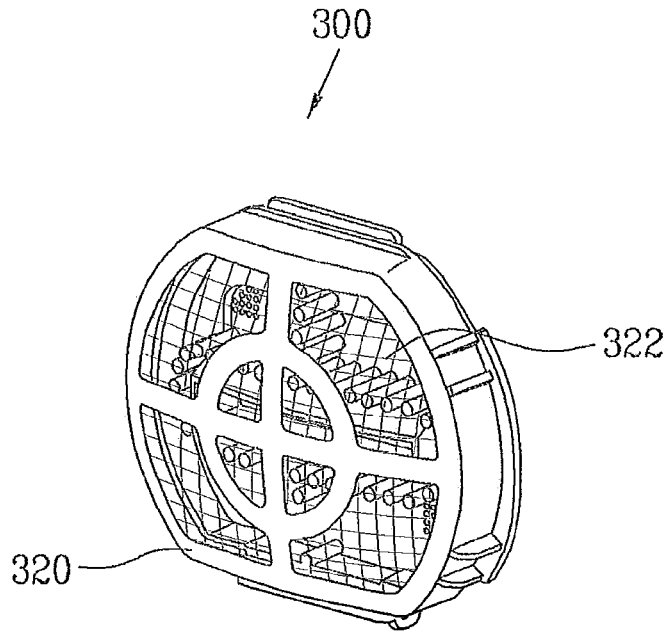
FIG. 4A is a perspective diagram of a closed-type filter unit provided to a washer filter assembly according -to the present invention.
Figure 4B:
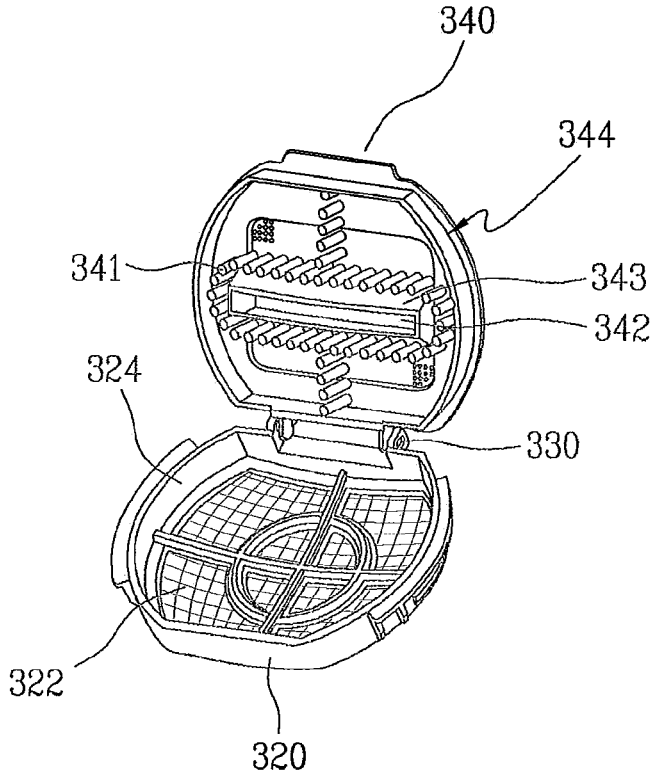
FIG. 4B is a perspective diagram for an open state of the closed-type filter unit shown in FIG. 4A.

FIG. 4A is a perspective diagram of a closed-type filter unit provided to a washer filter assembly according to the present invention. And, FIG. 4B is a perspective diagram for a state that the closed-type filter unit is open.

In the following description, a configuration of the closed-type filter unit 300 of the present invention is explained.

First of all, the closed-type filter unit 300 includes a front cover 320 for filtering off particles contained in water and a rear cover 340 assembled to the front cover 320.

The front cover 320 and the rear cover 340 can be assembled together in a rotational configuration. This can be implemented by engaging a hinge member 330 between the front cover 320 and the rear cover 340.

A front side of the front cover 320 includes a mesh 322 configured to filter water by filtering off particles contained in the water when the water passes through the front cover 320.

The front cover 320 can include a first rib 324 configured to backward extend along a circumference of the front cover 320.

The rear cover 340 is configured to guide water introduced via the outlet 820 and can include an inlet 342, a passage rib 343 and a second rib 344.

The inlet 342 can be provided to a central part of the rear cover 340 to correspond to the outlet 820 provided to the inner wall 810.

The second rib 344 is configured to extend forward along a circumference of the rear cover 340 and is also configured to be fitted in the first rib 324.

Once the front cover and the rear cover 340 are assembled together, the second rib 344 is assembled with the first rib 324 by coming into contact with the first rib 324. Therefore, a sealed space is provided to prevent the water introduced from the outlet from entering outer parts except the mesh 322.

In particular, once the front cover 320 and the rear cover 340 are assembled together, the first rib 324 provided to the front cover 320 covers the second rib 344 provided to the rear cover 340 so that circumferential parts of the front and rear covers 320 and 340 can be completely sealed. Therefore, particles accommodated within the closed-type filter unit 300 according to the mesh 322 are prevented from being discharged outside the closed-type filter unit 300.

The passage rib 343 is provided to a circumference of the inlet 342 provided to the rear cover 340. And, the passage rib 343 can be configured to extend toward a front side of the rear cover 340 with a prescribed inclination.

Moreover, the passage rib 343 is configured to guide the water introduced into the closed-type filter unit 300 from the outlet 820 via the inlet 342.

In particular, the passage rib 343 extends toward the front side of the rear cover 340 to enable the introduced water to be directly introduced into the mesh 322 of the front cover 320.

The passage rib 343 is configured to have the prescribed inclination in order to minimize a backward flow of the water introduced into the closed-type filter unit 300 in a direction of the inlet 342. And, the passage rib 343 is provided with the prescribed inclination to prevent the particles filtered off by the closed-type filter unit from being discharged via the inlet 342.

Figure 5:
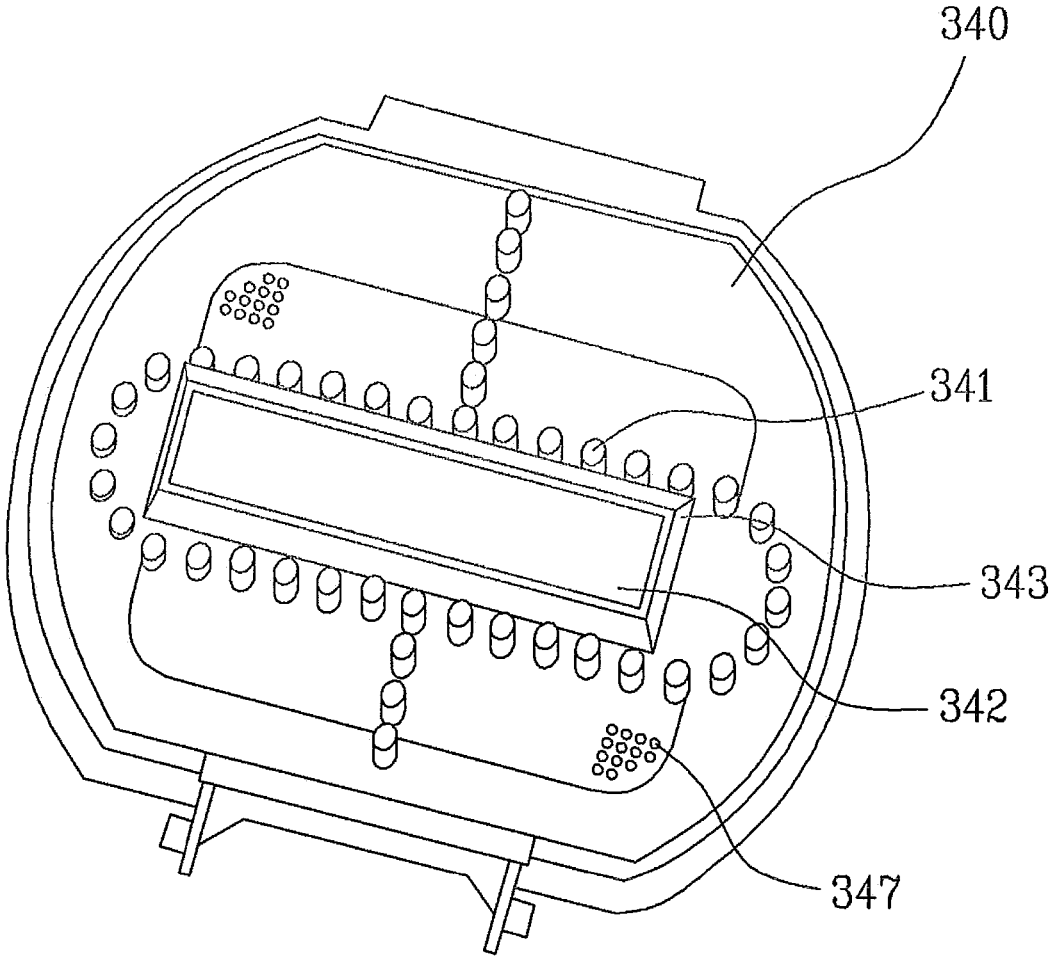
FIG. 5 is a perspective diagram of a rear cover of a washer filter assembly of a washer according to the present invention.

FIG. 5 is a perspective diagram of a rear cover of a washer filter assembly of a washer according to the present invention.

Referring to FIG. 5, the rear cover 340 can further include a multitude of projections 341 and a multitude of ventilation holes 347.

The projections 341 are configured to collect the particles contained in the water introduced into the closed-type filter unit 300 and are preferably provided along an outer circumference of the inlet 342.

A multitude of the projections 341 are provided in a manner of projecting from the rear cover 340 in a direction of the front cover 320 to be spaced apart from each other with a prescribed interval in-between.

Therefore, the projections 341 are able to prevent the particles, which are contained in the water introduced into the closed-type filter unit 300, from escaping through the inlet 342 in a manner that the particles are stuck by the spaces provided by the projections 341.

The ventilation holes 347 are configured to perforate a bottom of the rear cover 340, whereby dampness and/or water can be removed from the closed-type filter unit 300.

Ventilation may not be smoothly performed within the closed-type filer unit 300 if the front and rear covers 320 and 340 are closed.

In this case, if the damp particles are stuck and left between the projections 341 for long duration, it may cause a problem of decomposition within the closed-type filter unit 300.

Therefore, the ventilation holes 347 enable the inner space of the closed-type filter unit 300 to be ventilated, whereby the above problem can be solved.

Preferably, in order to facilitate the ventilation of the closed-type filter unit 300, a multitude of the ventilation holes 347 are provided to the rear cover 340 failing to have the inlet 342, the passage rib 343 and he projections 341.

Preferably, a size of the corresponding ventilation hole 347 is configured smaller than a size of each of the particles to prevent the particles from escaping from the closed-type filter unit 300 via the ventilation holes 347.

In the following description, operations of the above-configured water filter assembly 400 are explained.

First of all, in performing a washing or rinsing course, the pulsator 120 is rotated by the drive assembly 500.

Once the pulsator 120 is rotated, a strong water current is radially generated from water by a corresponding rotational force of the pulsator 120 so that the water can flow upward along the circulation passage 800*a* from a lower part of the wash tub 800.

Subsequently, the water is introduced into the wash tub 800 via the outlet 820 provided to the circulation passage 800 and the filer assembly 400 provided to the outlet 820.

In doing so, the water having passed through the outlet 820 is introduced into the closed-type filter unit 300 via the inlet 342 provided to the rear cover 340 of the closed-type filter unit 300.

And, particles contained in the water introduced into the closed-type filter unit 300 are filtered off by the mesh 322 provided to the front cover 320.

In this case, since the circumferences of the front and rear covers 320 and 340 configuring the closed-type filter unit 300 are sealed by the first rib 324 provided to the front cover 320 and the second rib 344 provided to the rear cover 340, the particles filtered off by the mesh 322 are not discharged from the closed-type filter unit 300.

Moreover, the inclining passage rib 343 is provided around the inlet 342 to guide the water introduced into the closed-type filter unit 300 and to prevent the water from flowing backward in a direction of the inlet 342.

As the water is introduced via the inlet 342, the particles are stuck in the gaps provided by a multitude of the projections 341. Hence, even if the water flows backward, it is able to prevent the particles from being externally discharged via the inlet 342.

Moreover, as a multitude of the ventilation holes 347 are provided to the rear cover 340, air circulation can be smoothly performed between the closed-type filter unit 300 and an external environment. Therefore, it is able to prevent the particles from being decomposed within the closed-type filter unit 300.

Meanwhile, the water having passed through the closed-type filter unit 300 is injected into the wash tub via the injection hole 210 provided to the cap 200.

In this case, a multitude of injection holes 210 are provided to the cap so that the water through the closed-type filter unit can be introduced into the wash tub 800 via narrow holes. Thus, it is able to provide the water with a strong injection pressure.

Therefore, the water through the injection holes is sprayed onto the laundry stored in the wash tub, whereby washing or rinsing efficiency can be raised.

Moreover, the filter assembly 400 of the washer according to the present invention is provided not to be projected from the inner wall 810, thereby preventing laundry from being damaged by the contact in-between in the course of a washing process.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A filter assembly of a washer, which includes an inner wall having an outlet and a circulation passage to enable water to circulate to the outlet from a wash tub, the filter assembly comprising:

a rear cover having an inlet for introducing the water discharged from the outlet of the inner wall;

a front cover assembled with the rear cover and having a mesh for filtering off the particles from the water discharged from the outlet and to prevent the filtered-off particles from being externally discharged; and a passage rib configured to guide an introduction of the water along a circumference of the inlet, wherein the passage rib extends towards the front side of the rear cover to enable the introduced water to be directly introduced into the mesh, and wherein the passage rib is configured to incline to prevent a backward flow of the water, wherein the rear cover includes a plurality of projections provided around the inlet and configured to collect the particles in a manner that the particles are stuck by spaces provided by the projections, and wherein the inner wall includes a recess for enabling the filter assembly to be accommodated therein, and the filter assembly is inserted into the recess to be in a plane formed by the inner wall.

2. The filter assembly of the washer of claim 1, wherein the filter assembly further comprises a multitude of ventilation holes configured to perforate the rear cover.

3. The filter assembly of the washer of claim 1, wherein a multitude of the projections are provided around the passage rib.

4. The filter assembly of the washer of claim 1, further comprising a cap having an injection hole for enabling the water through the closed-type filter unit to be injected into the wash tub.

5. The filter assembly of the washer of claim 4, wherein the cap is detachably attached to an upper part of the front cover.

* * * * *